US008530128B2

(12) United States Patent
Jang et al.

(10) Patent No.: US 8,530,128 B2
(45) Date of Patent: Sep. 10, 2013

(54) POLYMERIZED TONER AND METHOD FOR MANUFACTURING SAME

(75) Inventors: Wook Jang, Daejeon (KR); Chang-Soon Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 0 days.

(21) Appl. No.: 13/580,914

(22) PCT Filed: Feb. 23, 2011

(86) PCT No.: PCT/KR2011/001242

§ 371 (c)(1), (2), (4) Date: Nov. 5, 2012

(87) PCT Pub. No.: WO2011/105793

PCT Pub. Date: Sep. 1, 2011

(65) Prior Publication Data

US 2013/0052579 A1 Feb. 28, 2013

(30) Foreign Application Priority Data

Feb. 23, 2010 (KR) ..... 10-2010-0016410
Feb. 22, 2011 (KR) ..... 10-2011-0015586

(51) Int. Cl.
*G03G 9/087* (2006.01)

(52) U.S. Cl.
USPC ..... 430/109.1; 430/110.1; 430/137.15

(58) Field of Classification Search
USPC ..... 430/109.1, 110.1, 137.15
See application file for complete search history.

(56) References Cited

U.S. PATENT DOCUMENTS

| | | | | |
|---|---|---|---|---|
| 5,244,765 | A | 9/1993 | Katoh et al. | |
| 5,962,176 | A | 10/1999 | Ohno et al. | |
| 2005/0175921 | A1 * | 8/2005 | Morris et al. | 430/109.3 |
| 2006/0141380 | A1 * | 6/2006 | Yamazaki et al. | 430/109.2 |
| 2008/0124643 | A1 * | 5/2008 | Yoshiba et al. | 430/108.7 |
| 2008/0138736 | A1 * | 6/2008 | Jeong et al. | 430/111.4 |
| 2009/0257788 | A1 * | 10/2009 | Matsuda et al. | 399/274 |
| 2010/0055591 | A1 * | 3/2010 | Chiu et al. | 430/108.2 |

FOREIGN PATENT DOCUMENTS

| | | | |
|---|---|---|---|
| JP | 08-166687 | A | 6/1996 |
| JP | 11-282205 | A | 10/1999 |
| KR | 10-0853878 | A | 8/2008 |

* cited by examiner

*Primary Examiner* — Hoa V Le
(74) *Attorney, Agent, or Firm* — Rothwell, Figg, Ernst & Manbeck, P.C.

(57) ABSTRACT

The present invention relates to a polymerized toner including a low molecular weight polymer having a weight average molecular weight of 3000 to 30,000 and a method for preparing the same, wherein the polymerized toner can realize excellent gloss and offset feature and can also can exhibit excellent performance in the applications of high speed copying, development of transferred photos, etc.

20 Claims, 1 Drawing Sheet

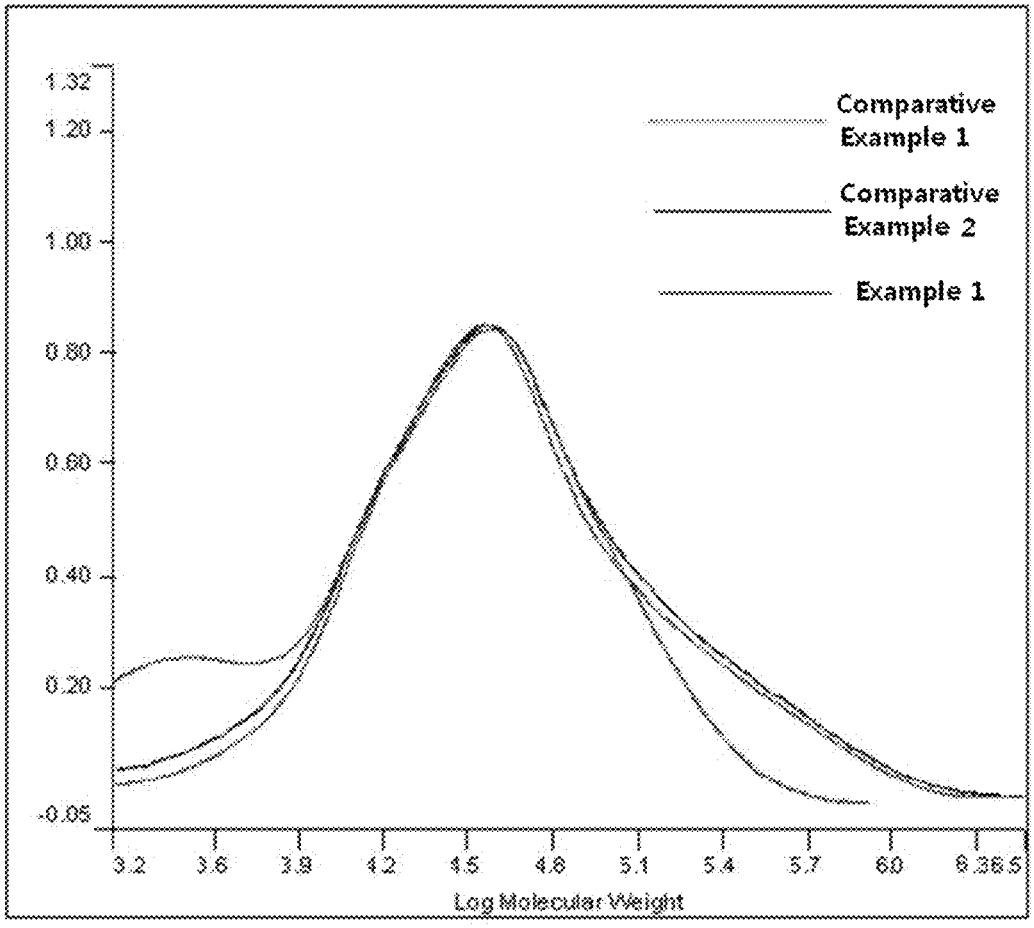
1.32
1.20
1.00
0.80
0.60
0.40
0.20
-0.05
Comparative Example 1
Comparative Example 2
Example 1
3.2
3.6
3.9
4.2
4.5
4.8
5.1
5.4
5.7
6.0
6.36.5
Log Molecular Weight

POLYMERIZED TONER AND METHOD FOR MANUFACTURING SAME

TECHNICAL FIELD

The present invention relates to a polymerized toner and a method for preparing the same. More specifically, the present invention relates to a polymerized toner and a method for preparing the same wherein the toner can realize excellent gloss and offset feature and thus can exhibit excellent performances in the applications of high-speed copying, development of transferred photos, etc.

The present application claims priority to and the benefit of Korean Patent Application Nos. 10-2010-0016410 and 10-2011-0015586 filed with the Korean Intellectual Property Office on Feb. 23, 2010 and Feb. 22, 2011, respectively, which are incorporated herein by reference in their entirety.

BACKGROUND ART

Toners are used in the development of electronic pictures, electrostatic printers, copy machines, etc., and can be defined as paint that is capable of being transferred to and fixed on an object to form a desired pattern. As computers are more commonly used in word processing in recent years, there have been rapidly growing demands for image forming apparatuses such as printers, resulting in an increase of the amount of toners used as well.

Typically, toners are prepared by using a pulverization method or a polymerization method. The most widely known is a preparation method by using the pulverization, wherein resins and pigments are put into a melt-mixing process together, melt-mixed or extruded, and then pulverized and sorted to give toner particles. However, this method has drawbacks in that the toner particles thus obtained have a broad particle size distribution and very irregular shapes including sharpened edges resulting in inferior chargeability or flowability.

For the purpose of addressing the above-mentioned problems, a method for preparing spherical toner particles by using a polymerization method was proposed. For such a preparation method of toners by using polymerization, emulsion polymerization (coagulation method) and suspension polymerization are known in the art. The method for preparing toners by using the suspension polymerization is preferred since the emulsion polymerization has difficulties in controlling the particle size distribution and reproducing the quality of the obtained toners.

In the suspension polymerization, the binder resin monomer and various additives including a pigment, a wax, a charge control agent, an initiator, etc. are uniformly dispersed to provide a monomer mixture, which is then dispersed in an aqueous dispersion and subjected to a polymerization reaction to give particles having a diameter of about 6 to 10 μm that is appropriate as toner particles.

In the polymerized toner given by the suspension polymerization, a binder resin having a high molecular weight is contained as a monomer for the binder resin to be polymerized. Due to the binder resin having a high molecular weight, there is a problem that the gloss of prints is lowered. In order to solve such a problem, a method for realizing high gloss in prints has been proposed by adding a molecular weight control agent along with a variety of additives such as a wax, a charge control agent, etc. However, according to this method, the molecular weight of the binder resin is lowered to deteriorate the offset feature. Accordingly, there has been a need for research to develop a polymerized toner that not only may be prepared by a suspension polymerization method but that may also realize high gloss as well as an excellent offset feature.

CONTENTS OF THE INVENTION

Problems to be Solved

The present invention provides a polymerized toner which can realize the excellent gloss and offset feature and can also exhibit excellent performance in the applications of high speed copying, development of transferred photos, etc.

The present invention also provides a method for the preparation of said polymerized toner.

Technical Means

The present invention provides a polymerized toner which includes 20 to 90 wt % of a binder resin; 3 to 30 wt % of a low molecular weight polymer having the same type of repeating unit as the binder resin and a weight average molecular weight of 3000 to 30,000; and a balances of a pigment, a charge control agent, and a wax, wherein said polymer, pigment, charge control agent, and wax are dispersed in said binder resin.

In addition, the present invention provides a method for preparing the polymerized toner, which includes the steps of forming an aqueous dispersion containing a dispersant, forming a monomer mixture which includes 20 to 90 wt % of a binder resin monomer, 3 to 30 wt % of low molecular weight polymer having the same type of repeating unit as the binder resin and a weight average molecular weight of 3000 to 30,000, and a balance of a pigment, a charge control agent, and a wax, and forming toner particles through suspension polymerization after adding said monomer mixture to said aqueous dispersion.

Hereinafter, the polymerized toner and preparation method of the same according to one embodiment of the invention will be explained in detail.

According to one embodiment of the invention, a polymerized toner which includes 20 to 90 wt % of binder resin; 3 to 30 wt % of low molecular weight polymer having the same type of repeating unit as the binder resin and a weight average molecular weight of 3000 to 30,000; and balances of pigment, charge control agent and wax, wherein said polymer, pigment, charge control agent and wax are dispersed in said binder resin, is provided.

The present inventors have confirmed through experiments that a polymerized toner including 3 to 30 wt %, preferably 5 to 25 wt %, of the low molecular weight polymer which has the same type of repeating unit as the binder resin and is dispersed in the binder resin of the toner particles can improve the gloss of prints as well as minimize the occurrence of hot offset, and then completed the present invention. Since such a polymerized toner can improve the gloss of prints, it may be applied to a field of photograph printing, etc., wherein high resolution and a high degree of color realization are required, or to a field wherein high speed copying is required.

Furthermore, as confirmed in the following Experiment 2, the polymerized toner according to one embodiment of the invention may show a first peak of 100,000 to 200,000 (preferably, 120,000 to 170,000) and a second peak of 3000 to 30,000 in molecular weight distribution measured by gel-permeation chromatography of a THF-soluble component.

The first peak is due to the binder resin on the toner particles, and the second peak is due to the low molecular weight polymer having a weight average molecular weight of 3000 to 30,000. According to this, the polymerized toner may have the bi-modal peak distribution. When the existing polymerized toner whose binder resin includes only the high molecular weight polymer having a weight average molecular weight of 100,000 or more is used, it is not easy to obtain the high gloss. If a molecular weight control agent is added to realize high gloss, the offset feature is deteriorated (see Comparative Examples 1 and 4). On the contrary, as can be seen from the following Experiments 1 and 2 and FIG. 1, the polymerized toner of one embodiment of the present invention is identified to show the bi-modal molecular weight distribution and can realize high gloss and an excellent offset feature since the above low molecular weight polymer is dispersed in the binder resin having a high weight average molecular weight of 100,000 or more.

On the other hand, the toner particles may include the low molecular weight polymer in the amount of 3 to 30 wt %, preferably 5 to 25 wt %. This low molecular weight polymer includes the same repeating unit as the binder resin and thus has excellent compatibility with the binder resin and can be uniformly distributed in the binder resin. Also, the low molecular weight polymer uniformly distributed in the toner particles may allow the toner particles to have excellent storage stability even at a high temperature. In particular, as the low molecular weight polymer is contained in the toner particles in the amount of 3 to 30 wt %, preferably 5 to 25 wt %, the content of the low molecular weight resin increases to appropriately control the molecular weight distribution together with the binder resin. According to this, the fixedness and gloss of the toner particles may be improved. If the content of the low molecular weight polymer is less than 3 wt %, the effect of improving the gloss is trifling to show gloss of 20 or less. But, if the content is more than 30 wt %, hot-offset may occur during the printing. The "same type" of the repeating unit as the binder resin monomer means the repeating unit derived from the compounds used as the binder resin monomer, their derivatives, or compounds in the same family.

In addition, as the low molecular weight polymer has a weight average molecular weight of 3000 to 30,000, it can play a role of placing more weight on the low molecular weight portion in the molecular weight distribution of the polymerized toner and can increase the fixedness and gloss of the toner. If the weight average molecular weight of the low molecular weight polymer is less then 3000, a resulting picture may not be uniform due to deterioration of print quality as a result of evaluation of photo development. However, if it exceeds 30,000, the low molecular weight polymer can hardly be applied to the field of development of transferred photos, etc., due to deterioration of gloss in the prints.

On the other hand, the polymerized toner may further include 0.01 to 5 wt %, preferably 0.1 to 3 wt %, of the molecular weight control agent distributed in the binder resin. If the molecular weight control agent is added to the binder resin, the average molecular weight of the binder resin may be suitably controlled, e.g., lowered to a certain level. to improve the fixedness and gloss of the toner particles. When the content of the molecular weight control agent is less than 0.01 wt %, it is not easy to control the molecular weight of the binder resin, and the fixedness and gloss of the toner particles cannot be sufficiently secured. Also, when the content of the molecular weight control agent exceeds 5 wt %, some problems of broadening the particle diameter distribution and the deterioration of transfer efficiency may occur.

The molecular weight control agent may include t-dodecyl mercaptan, n-dodecyl mercaptan, n-octyl mercaptan, carbon tetrachloride, carbon tetrabromide, or mixtures thereof.

The binder resin may include a polymer of one or more monomers selected from the group consisting of a styrene monomer, an acrylate monomer, a methacrylate monomer, a diene monomer, an acidic olefin monomer, and a basic olefin monomer. More preferably, such a binder resin may include a copolymer of (a) a styrene monomer and (b) one or more monomers selected from the group consisting of an acrylate monomer, a methacrylate monomer, and a diene monomer.

The styrene monomer may include styrene, monochlorostyrene, methyl styrene, dimethyl styrene, etc., and the acrylate monomer may include methyl acrylate, ethyl acrylate, n-butyl acrylate, isobutyl acrylate, dodecyl acrylate, 2-ethylhexyl acrylate, etc. The methacrylate monomer may include methyl methacrylate, ethyl methacrylate, n-butyl methacrylate, isobutyl methacrylate, dodecyl methacrylate, 2-ethylhexyl methacrylate, etc. The diene monomer may include butadiene, isoprene, etc. Also, an $\alpha,\beta$-ethylene compound, etc. may be used as the acidic olefin monomer, and an aliphatic alcohol methacrylic acid ester having an amine or quaternary ammonium group, methacryl amide, vinyl amine, diallyl amine, their ammonium salts, etc. may be used as the basic olefin monomer.

The binder resin may include polymers or copolymers having a weight average molecular weight of 100,000 to 200,000, preferably 120,000 to 180,000. If the weight average molecular weight of such polymers or copolymers is less than 100,000, the offset feature may be deteriorated. If it exceeds 200,000, the gloss of prints may be deteriorated.

On the other hand, the low molecular weight polymer having a weight average molecular weight of 3000 to 30,000 may include the same repeating unit as the binder resin. As mentioned above, the binder resin includes one or more monomers selected from the group consisting of a styrene monomer, an acrylate monomer, a methacrylate monomer, a diene monomer, an acidic olefin monomer, and a basic olefin monomer. Also, the low molecular weight polymer may include the same repeating unit as the polymer that can be used as the binder resin.

The pigment includes a metal powder pigment, a metal oxide pigment, a carbon pigment, a sulfide pigment, a chromium pigment, a ferrocyanide pigment, an azo pigment, an acidic dye pigment, a basic dye pigment, a mordant dye pigment, a phthalocyanine pigment, a quinacridone pigment, a dioxane pigment, or mixtures thereof. However, the pigment is not restricted to the above, and any pigment known to be applicable to a polymerized toner may be used without special limitation.

The wax may include petroleum refining waxes such as paraffin wax, microcrystalline wax, ceresin wax, etc., natural wax such as carnauba wax, etc., synthetic wax such as polyester wax, polyethylene wax, polypropylene wax, etc., or mixtures thereof. However, the wax is not restricted to the above, and any wax known to be applicable to the polymerized toner may be used without special limitation.

The charge control agent may include a cationic charge control agent, an anionic charge control agent, or mixtures thereof. As the cationic charge control agent, nigrosine dye, a higher aliphatic metal salt, an alkoxyamine, a chelate, a quaternary ammonium salt, an alkyl amide, a fluorine-treated activator, a naphthalenic acid metal salt, or mixtures thereof may be mentioned. As the anionic charge control agent, a chlorinated paraffin, a chlorinated polyester, a polyester having an acid, a sulfonylamine of copper phthalocyanine, a sulfonic acid group, or mixtures thereof may be mentioned.

Also, it is preferable to use the copolymer having a sulfonic acid group as the charge control agent, and it is more preferable to use the copolymer having a sulfonic acid group whose weight average molecular weight is between 2000 and 200,000. Still more preferably, a copolymer having a sulfonic acid group whose acid value is between 1 and 40 mg KOH/g and glass transition temperature is between 30 and 120° C. may be used. If the acid value is less than 1, it cannot play a role as the charge control agent. And, if the acid value is 40 or more, it may influence the interfacial properties of the monomer mixture to deteriorate the polymerization stability. If the glass transition temperature is less than 30° C., due to the low glass transition temperature of the electron control agent which is exposed on the surface, friction-melting of the toner versus toner may occur during printing to cause a blocking phenomena. And, if the glass transition temperature exceeds 120° C., the surface of the toner becomes too hard to have beneficial characteristics in coating property and fixedness. If the weight average molecular weight is less than 2000, the surface concentration may be lowered and the function as the charge control agent may not be effective due to the high compatibility with the binder resin. Further, a weight average molecular weight of 200,000 or more is not advantageous for the polymerization stability and particle size distribution because of a viscosity increase of the monomer mixture due to the high molecular weight. As specific examples of the copolymer having a sulfonic acid group, a styrene-acrylic copolymer having a sulfonic acid group, a styrene-methacrylic copolymer having a sulfonic acid group, or mixtures thereof may be mentioned, but are not limited thereto.

Some additives such as reaction initiator, a cross-linking agent, a pigment stabilizer, etc. may be further dispersed in the binder resin.

The reaction initiator may include an oil-soluble initiator and a water-soluble initiator. Specifically, azo initiators such as azobisisobutyronitrile, azobisvaleronitrile, etc., organic peroxides such as benzoyl peroxide, lauroyl peroxide, etc., typically used water-soluble initiators such as potassium persulfate, ammonium persulfate, etc. may be mentioned, and mixtures of two or more selected therefrom may be used.

The cross-linking agent may include divinyl benzene, ethylene dimethacrylate, ethylene glycol dimethacrylate, diethylene glycol diacrylate, 1,6-hexamethylene diacrylate, allyl methacrylate, 1,1,1-trimethylol propane triacrylate, triallyl amine, tetraallyloxy ethane, or mixtures thereof.

As the pigment stabilizer, a styrene-butadiene-styrene (SBS) copolymer having a weight average molecular weight of 2000 to 200,000 may be used. Preferably, the copolymer whose styrene to butadiene content is 10-90 to 90-10 by weight may be used. If the styrene content exceeds 90%, the block length of butadiene becomes short and thus the copolymer cannot sufficiently play a role as a stabilizer due to the high compatibility with the binder resin. Further, if the styrene content is less than 10%, the copolymer sufficiently plays a role as a stabilizer but it cannot sufficiently control the action of pigment to pigment due to the short length of the styrene block. If the molecular weight is less than 2000, the copolymer cannot play a role as a pigment due to the high compatibility with the binder resin. Also, if the molecular weight is 200,000 or more, the viscosity of the monomer mixture becomes so high that the dispersion stability and polymerization stability may be deteriorated and ultimately the demerit of broadening the particle size distribution may be shown.

On the other hand, the polymerized toner may further include an external additive including one or more selected from the group consisting of silica and titanium dioxide. Such an external additive may be present in the form of a coating on the outside of the toner particles. The silica is preferably surface-treated with a silane compound such as dimethyldichlorosilane, dimethylpolysiloxane, hexamethyldisilazane, aminosilane, alkylsilane, octamethylcyclotetrasiloxane, etc. The titanium dioxide may be used alone or as a mixture in a rutile structure that is stable at a high temperature or an anatase structure that is stable at a low temperature, and it may have a particle size of 80 to 200 nm, preferably 100 to 150 nm.

According to one embodiment of the invention, there may be provided a method for preparing the polymerized toner which includes steps of forming an aqueous dispersion containing a dispersant, forming a monomer mixture which includes 20 to 90 wt % of a binder resin monomer, 3 to 30 wt % of a low molecular weight polymer having the same type of repeating unit as the binder resin monomer and a weight average molecular weight of 3000 to 30,000, and a balance of a pigment, a wax, and a charge control agent, and adding said monomer mixture to said aqueous dispersion to form toner particles through suspension polymerization.

The present inventors have confirmed through experiments that a polymerized toner that can improve the gloss of prints as well as minimize the occurrence of hot offset may be prepared if a monomer mixture containing the low molecular weight polymer having a weight average molecular weight of 3000 to 30,000 in a specific amount is mixed with the aqueous dispersion containing the specific dispersant and subjected to suspension polymerization, and then completed the present invention. Accordingly, since the polymerized toner as prepared above can improve the gloss of prints, it may easily be applied to a field of photograph printing, etc., wherein high resolution and a high degree of color realization are required, or to a field wherein high speed copying is required.

The monomer mixture may contain the same type of repeating unit as the binder resin monomer and 3 to 30 wt %, preferably 5 to 25 wt %, of the low molecular weight polymer having a weight average molecular weight of 3000 to 30,000. The low molecular weight polymer has the same type of repeating unit as the binder resin and is highly compatible with the binder resin. Thus, it may be uniformly distributed in the binder resin and also uniformly distributed in the toner particles, which makes the toner particles have excellent storage stability at a high temperature. When the content of the low molecular weight polymer is less than 3 wt %, the improvement of gloss is insignificant to show gloss of 20 or less. If the content thereof exceeds 30 wt %, hot offset may occur during the printing process.

The monomer mixture may further include 0.01 to 5 wt %, preferably 0.1 to 3 wt %, of the molecular weight control agent dispersed in the binder resin. As the molecular weight control agent is additionally used in the binder resin, the average molecular weight of the binder resin may be suitably controlled, e.g., decreased to some level, to improve the fixedness and gloss of the toner particles. If the content of the molecular weight control agent is less than 0.01 wt %, it is not easy to control the molecular weight of the binder resin, and the fixedness and gloss of the toner particles may not be sufficiently secured. On the contrary, if the content of the molecular weight control agent exceeds 5 wt %, the particle size distribution of the toner is broadened to cause the problem of deterioration of the transfer efficiency.

As the molecular weight control agent, t-dodecyl mercaptan, n-dodecyl mercaptan, n-octyl mercaptan, carbon tetrachloride, carbon tetrabromide, or mixtures thereof may be used.

On the other hand, as the dispersant for the step of forming the aqueous dispersion, an inorganic dispersant, an organic dispersant, an anionic surfactant, or mixtures thereof may be used. Such a dispersant may be applied in the amount of 1 to 5 parts by weight with respect to 100 parts by weight of the monomer mixture.

Specific examples of the inorganic dispersant include calcium phosphate, calcium hydrogen phosphate, calcium dihydrogen phosphate, hydroxy apatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, mixtures thereof, etc.

Specific examples of the organic dispersant include polyvinyl alcohol, gelatin, methyl cellulose, methyl hydroxy propyl cellulose, ethyl cellulose, carboxyl methyl cellulose and its sodium salt, polyacrylic acid and its salt, starch, mixtures thereof, etc.

Specific examples of the anionic surfactant include fatty acid salts, alkyl sulfate, alkyl aryl sulfate, dialkyl sulfosuccinate, alkyl phosphate, mixtures thereof, etc.

The more preferable example of the dispersant is calcium phosphate. Calcium phosphate may be obtained by mixing an aqueous sodium phosphate solution and an aqueous calcium chloride solution to precipitate crystals in an aqueous solution. The calcium phosphate crystals may be uniformly dispersed in the aqueous dispersion.

On the other hand, the monomer mixture may be formed by mixing the binder resin monomer, the low molecular weight polymer having a weight average molecular weight of 3000 to 30,000, the pigment, the wax, the charge control agent, etc., and sufficiently dissolving them. The monomer mixture may be homogenized in the aqueous dispersion using a homogenizer.

The binder resin monomer may include a styrene monomer, an acrylate monomer, a methacrylate monomer, a diene monomer, or mixtures thereof, and selectively an acidic olefin monomer, a basic olefin monomer, or mixtures thereof may be used. More preferably, the binder resin monomer may include the styrene monomer, and one or more monomers selected from the group consisting of an acrylate monomer, a methacrylate monomer, and a diene monomer in the weight ratio of 10:1 to 1:1. If the monomers are mixed in the above ratio and polymerized, the glass transition temperature (Tg) of the resulting binder resin may be controlled to an appropriate range to realize the excellent offset feature. That is, cold offset may occur when the weight ratio exceeds 10:1, and hot offset may occur when the ratio is less than 1:1.

The binder resin monomer may be contained in the amount of 20 to 90 parts by weight with respect to 100 parts by weight of the monomer mixture, and specific examples thereof are as mentioned above.

As aforementioned, the repeating unit contained in the low molecular weight polymer having a weight average molecular weight of 3000 to 30,000 may be the same as the repeating unit contained in the binder resin which is formed by the polymerization of the binder resin monomer.

The specific examples of the pigment, wax, and charge control agent contained in the monomer mixture are as mentioned above. The pigment may be used in an amount of 1 to 20 parts by weight, the wax in an amount of 0.1 to 30 parts by weight, and the charge control agent in an amount of 0.1 to 5 parts by weight, each of which is with respect to 100 parts by weight of the monomer mixture.

The monomer mixture may further include additives such as a reaction initiator, a cross-linking agent, a pigment stabilizer, mixtures thereof, etc. Specific examples of the additives are as mentioned above. With respect to 100 parts by weight of the monomer mixture (e.g., with respect to 100 parts by weight of the mixture of the binder resin monomer, the low molecular weight polymer, the pigment, the wax, the charge control agent, and the additives), the reaction initiator may be used in the amount of 0.01 to 5 parts by weight, more preferably 0.1 to 2.0 parts by weight, the cross-linking agent in the amount of 0.001 to 10 parts by weight, and the pigment stabilizer in the amount of 0.1 to 20 parts by weight, respectively.

In one embodiment of the invention, the monomer mixture may be added to the aqueous dispersion to form toner particles through the suspension polymerization. More specifically, the method for forming the toner particles may include the step of adding the monomer mixture to the aqueous dispersion, the step of applying shearing force to the aqueous dispersion and the monomer mixture to homogenize the monomer mixture in the aqueous dispersion in the form of liquid droplets, and the step of subjecting the homogenized monomer mixture to suspension polymerization. Further, as mentioned above, the monomer mixture and aqueous dispersion may be homogenized using a homogenizer.

If the polymerization is carried out by uniformly dispersing the monomer mixture in the aqueous dispersion in the form of fine water droplets, spherical toner particles having an appropriate size can be formed. For the purpose of dispersion in the form of fine water droplets (liquid droplets), shearing force may be applied to the monomer mixture and aqueous dispersion using a homogenizer to homogenize the monomer mixture in the aqueous dispersion. Specifically, the monomer mixture in the aqueous dispersion may be homogenized at a rate of 5000 to 20,000 rpm, preferably 8000 to 17,000 rpm using a homogenizer to disperse the monomer mixture in the aqueous dispersion in the form of a fine water droplets.

On the other hand, in one embodiment of the invention, the method may further include the step of removing the dispersant and the step of drying the toner particles.

The step of removing the dispersant may include the step of controlling pH to be suitable for the dissolution of the dispersant. If the dispersion wherein the toner particles are formed is controlled to have pH of 2 or less, preferably 1.5 or less, by adding water-soluble inorganic acids such as hydrochloric acid, nitric acid, etc., the dispersant can be dissolved into the aqueous phase and removed from the toner particles. In the step of removing the dispersant, the pH is suitably controlled, the mixture is stirred for 5 h or more to sufficiently dissolve the dispersant, and then the toner slurry containing less than 50 wt % of water may be obtained using a filter. Also, the step of removing the dispersant may include the step of applying the shearing force using a homogenizer to homogenize the solution and the step of separating using a centrifuge. After the step of removing the dispersant, elimination of moisture using a filter and addition of excess distilled water may be repeated several times to remove the dispersant more efficiently.

The step of drying the toner particles includes the step of introducing a toner cake having no dispersant into an oven and drying it under vacuum at room temperature. However, the drying method is not limited thereto, and any drying method conventionally used in the preparation step of polymerized toner may be used without special limitation.

Also, in one embodiment of the invention, a step of coating the outside of the toner particles with an external additive may be further included. In this coating step, the surface of the toner particles may be coated with a separate external additive, for example, an inorganic powder containing silica, titanium dioxide, mixtures thereof, etc. This coating step with such an external additive may be done by adding the external additive to the toner particles and then stirring at a high speed using a Henschel mixer. Any silica known to be applicable to the polymerized toner may be used without special limitation. The inorganic powder that is applicable to the coating step is specifically explained above, and thus the detailed explanation thereon is omitted here.

Effect of the Invention

According to the present invention, a polymerized toner and a preparation method of the same are provided, wherein the toner can realize the excellent gloss and offset feature and can also exhibit excellent performances in the applications of high speed copying, development of transferred photos, etc.

BRIEF DESCRIPTION OF THE DRAWING

FIG. 1 represents the results of measuring the molecular weight distribution for the polymerized toner of Example 1 and Comparative Examples 1 and 4.

BEST MODE FOR CARRYING OUT THE INVENTION

Hereinafter, the actions and effects of the present invention will be illustrated in more detail by means of the following examples. However, these examples are provided only to assist the understanding of the present invention and it is not intended for the scope of the present invention to be limited in any manner by them.

EXAMPLES

Preparation of the Polymerized Toner

Example 1

1. Synthesis of the Low Molecular Weight Polymer

To 100 parts by weight of a mixture of styrene and n-butyl acrylate in the ratio of 8:2, 4 parts by weight of an azo nitrile initiator (V65, Waco Chemical Co.) and 2 parts by weight of a molecular weight control agent (tertiary-dodecyl mercaptan, TDDM) were added, which were then mixed at room temperature and subjected to bulk polymerization for 24 h at 90° C. to give a low molecular weight polymer having a weight average molecular weight of 5000.

2. Synthesis of Polymerized Toner

A 0.1 M aqueous sodium phosphate solution (686 g) and 1 M calcium chloride (100 g) were mixed in water (500 g) at the reaction temperature of 70° C. to give an aqueous dispersion wherein calcium phosphate was precipitated as crystals.

A binder resin monomer containing styrene (144 g) and n-butyl acrylate (36 g); the low molecular weight polymer having a weight average molecular weight of 5000 as prepared above (20 g); allyl methacrylate (4 g) as a cross-linking agent; n-dodecyl mercaptan (0.4 g) as a molecular weight control agent; and a sulfonic acid-containing styrene-acryl polymer having a weight average molecular weight of 16,500 (5 g) as a charge control agent (FCA1001NS, Fujikura Kasei) were mixed and thoroughly dissolved. Carbon black (MA100, Cabot) (10 g) was added thereto. The mixture was stirred for 2 h in a bead mill at 2000 rpm, then the beads were removed.

The mixture containing no beads was then heated to 70° C. in a water bath. Paraffin wax (20 g) was added, and stirred for 20 min. An azo nitrile initiator (V65, Wako) (3.6 g) was added and further stirred for 1 min and 30 sec to form a monomer mixture.

At this point, the weight of the monomer mixture was 243 g, and the content of the low molecular weight polymer in this monomer mixture was 8.23 wt %.

The monomer mixture was added to the aqueous dispersion, and a homogenization process was carried out by applying shearing force to the aqueous dispersion and the monomer mixture using a homogenizer at a rate of 13,000 rpm to disperse the monomer mixture in the aqueous dispersion in the form of fine liquid droplets. The thus homogenized mixture was reacted for 10 h at 70° C. while stirring using a paddle stirrer at 200 rpm to give the polymerized toner.

3. Removal of the Dispersant and Drying of the Toner Particles

Hydrochloric acid was added to the slurry containing the above polymerized toner particles to control pH to less than 2. The water content in the slurry was adjusted to less than 30 wt % by filtering. The slurry was diluted by adding distilled water in the amount of double the initial weight of the slurry, and the water content in the slurry was again adjusted to less than 30 wt % by filtering. Such dilution and filtering processes were repeated ten times to remove calcium phosphate and other impurities on the surface of the toner.

After the water was finally removed by filtering, the toner slurry cake was introduced into a vacuum oven and dried under vacuum for 48 h at room temperature to give the polymerized toner powder. The volume average particle diameter of the resulting polymerized toner core and the ratio (standard deviation) of the volume average particle diameter to the number average particle diameter were measured to be 7 μm and 1.26, respectively, by SEM.

4. Coating with External Additive

With respect to 100 parts by weight of the polymerized toner core, 2 parts by weight of silica was added, and the mixture was stirred at a high speed of 5000 rpm for 7 min using a Henschel mixer to coat the external additive on the surface of the polymerized toner core.

Example 2

A low molecular weight polymer having a weight average molecular weight of 15,000 was prepared according to the same procedure as Example 1, except that 4 parts by weight of the azo nitrile initiator (V65, Waco Chemical Co.) and 0.5 part by weight of the molecular weight control agent (tertiary-dodecyl mercaptan, TDDM) were applied to 100 parts by weight of styrene and n-butyl acrylate in the mixing ratio of 8:2.

Further, the polymerized toner was prepared according to the same procedure as Example 1 except that said low molecular weight polymer having a weight average molecular weight of 15,000 (20 g) was used.

Example 3

A polymerized toner was prepared according to the same procedure as Example 1, except that styrene (120.8 g), n-butyl acrylate (30.2 g) (maintaining the condition of styrene:n-butyl acrylate=4:1), and the low molecular weight polymer having a weight average molecular weight of 5000 (49 g) were used.

Example 4

A polymerized toner was prepared according to the same procedure as Example 1, except that monomers for the binder resin of styrene (150.28 g) and n-butyl acrylate (37.57 g) (maintaining the condition of styrene:n-butyl acrylate=4:1) and the low molecular weight polymer having a weight average molecular weight of 5000 (12.15 g) were used.

Example 5

A polymerized toner was prepared according to the same procedure as Example 1, except that monomers for the binder resin of styrene (175.6 g) and n-butyl acrylate (44.15 g) (maintaining the condition of styrene:n-butyl acrylate=4:1) and the low molecular weight polymer having a weight average molecular weight of 5000 (60.75 g) were used.

Example 6

A low molecular weight polymer having a weight average molecular weight of 25,000 was prepared according to the same procedure as Example 1, except that 4 parts by weight of the azo nitrile initiator (V65, Waco Chemical Co.) and 0.5 part by weight of the molecular weight control agent (tertiary-dodecyl mercaptan, TDDM) were applied to 100 parts by weight of styrene and n-butyl acrylate in the mixing ratio of 8:2.

Further, the polymerized toner was prepared according to the same procedure as Example 1 except that said low molecular weight polymer having a weight average molecular weight of 25,000 (20 g) was used.

COMPARATIVE EXAMPLE

Preparation of the Polymerized Toner

Comparative Example 1

A polymerized toner was prepared according to the same procedure as Example 1, except that styrene (160 g) and n-butyl acrylate (40 g) (maintaining the condition of styrene: n-butyl acrylate=4:1) were used and the low molecular weight polymer having a weight average molecular weight of 5000 was not added.

Comparative Example 2

A polymerized toner was prepared according to the same procedure as Example 1, except that styrene (65.6 g), n-butyl acrylate (16.4 g) (maintaining the condition of styrene:n-butyl acrylate=4:1), and the low molecular weight polymer having a weight average molecular weight of 5000 (98 g) were used.

Comparative Example 3

A low molecular weight polymer having a weight average molecular weight of 50,000 was prepared according to the same procedure as Example 1, except that 2 parts by weight of the azo nitrile initiator (V65, Waco Chemical Co.) was used with respect to 100 parts by weight of styrene and n-butyl acrylate in the mixing ratio of 8:2 and the molecular weight control agent was not used.

Further, the polymerized toner was prepared according to the same procedure as Example 1 except that said low molecular weight polymer having a weight average molecular weight of 50,000 (20 g) was used.

Comparative Example 4

A polymerized toner was prepared according to the same procedure as Example 1 except that the low molecular weight polymer was not added and n-dodecyl mercaptan (10 g) was used as the molecular weight control agent.

Comparative Example 5

A polymerized toner was prepared according to the same procedure as Example 1, except that monomers for the binder resin of styrene (92 g) and n-butyl acrylate (23 g) (maintaining the condition of styrene:n-butyl acrylate=4:1) and the low molecular weight polymer having a weight average molecular weight of 5000 (85 g) were used.

EXPERIMENT

Experiment 1

Determination of Offset Feature

An image (width: 1 cm, length: 5 cm) was printed five times at an interval of 5 cm on a sheet of A4-sized paper with a laser printer (HP2600, made by Hewlett Packard). Then, the offset feature was evaluated by determining whether any afterimage remained on the paper at an interval of 5.7 cm, a circumference of the fixing roll, in the rectangular print.

The degree of afterimage was observed with a microscope to count the number of afterimages in the form of spots in the area of 1 cm length and 1 cm width. The offset feature was determined to be poor when the number of spot is 20 or more, moderate when the number is 10-20, and good when the number is less than 10.

Experiment 2

Determination of Gloss

The front page of a sheet of A4-sized paper was printed with a laser printer (HP2600, made by Hewlett Packard). Then, the gloss was measured using a gloss meter (RD918, Macbeth).

The results of Experiments 1 and 2 obtained by using the polymerized toners of Examples 1 to 6 and Comparative Examples 1 to 5 are shown in the following Table 1.

TABLE 1

Results of measuring the offset feature and gloss

| | Content of low molecular weight polymer in toner particles (wt %) | Mw of low molecular weight polymer | Gloss | Offset feature |
|---|---|---|---|---|
| Example 1 | 8.23 | 5000 | 30 | Good |
| Example 2 | 8.23 | 15,000 | 28 | Good |
| Example 3 | 20.2 | 5000 | 32 | Good |
| Example 4 | 5 | 5000 | 30 | Good |
| Example 5 | 25 | 5000 | 25 | Good |
| Example 6 | 8.23 | 25,000 | 28 | Good |
| Comparative Example 1 | — | — | 20 | Good |

TABLE 1-continued

Results of measuring the offset feature and gloss

| | Content of low molecular weight polymer in toner particles (wt %) | Mw of low molecular weight polymer | Gloss | Offset feature |
|---|---|---|---|---|
| Comparative Example 2 | 40.3 | 5000 | 32 | Poor |
| Comparative Example 3 | 8.23 | 50,000 | 22 | Good |
| Comparative Example 4 | — | — | 30 | Poor |
| Comparative Example 5 | 35 | 15,000 | 30 | Poor |

Generally, color very similar to an ordinary photograph and high print quality can be realized only when the gloss unit of the print measured by the contact gloss meter such as RD918 (Macbeth Co.), etc. is 25 or more. As is confirmed from the above Table 1, when the polymerized toners according to Examples 1 to 6 are applied, not only is the gloss unit 25 or more, but also a good offset feature can be realized. Thus, such polymerized toners may be applied to the development of transferred photos, etc. that require high print quality.

On the contrary, the results of Table 1 confirm that a gloss unit of less than 25 or a poor offset feature is shown in such cases when the low molecular weight polymer having a weight average molecular weight of 3000 to 30,000 is not included (Comparative Examples 1 and 4), the content of the low molecular weight polymer is out of the range of 3 to 30 wt % (Comparative Examples 2 and 5), or the low molecular weight polymer has a weight average molecular weight out of the range of 3000 to 30,000 (Comparative Example 3).

Experiment 3

Measurement of Molecular Weight Distribution by Gel Permeation Chromatography (GPC)

The polymerized toners according to Example 1 and Comparative Examples 1 and 4 were dissolved in THF, and the THF-soluble component was loaded on the gel permeation chromatography equipment to measure the molecular weight distribution. Thus measured molecular weight distribution is shown in FIG. 1.

As can be seen from FIG. 1, Comparative Examples 1 and 4 show a molecular weight distribution in a uni-modal shape, whereas Example 1 in which the low molecular weight polymer having the molecular weight of 5000 is dispersed in the binder resin shows a molecular weight distribution in a bi-modal shape.

The invention claimed is:

1. A polymerized toner which comprises:

20 to 90 wt % of a binder resin;

3 to 30 wt % of a low molecular weight polymer having the same type of repeating unit as the binder resin and a weight average molecular weight of 3000 to 30,000; and a balance of a pigment, a charge control agent, and a wax, wherein said low molecular weight polymer, pigment, charge control agent, and wax are dispersed in said binder resin.

2. The polymerized toner according to claim 1, which has a first peak of 100,000 to 200,000 and a second peak of 3000 to 30,000 in molecular weight distribution measured by gel-permeation chromatography of a THF-soluble component.

3. The polymerized toner according to claim 1, which comprises 5 to 25 wt % of the low molecular weight polymer having the same type of repeating unit as the binder resin and a weight average molecular weight of 3000 to 30,000.

4. The polymerized toner according to claim 1, which further comprises 0.01 to 1 wt % of the molecular weight control agent dispersed in the binder resin.

5. The polymerized toner according to claim 4, wherein the molecular weight control agent comprises one or more selected from the group consisting of t-dodecyl mercaptan, n-dodecyl mercaptan, n-octyl mercaptan, carbon tetrachloride, and carbon tetrabromide.

6. The polymerized toner according to claim 1, wherein the binder resin comprises a polymer of one or more monomers selected from the group consisting of a styrene monomer, an acrylate monomer, a methacrylate monomer, a diene monomer, an acidic olefin monomer, and a basic olefin monomer.

7. The polymerized toner according to claim 1, wherein the binder resin is a copolymer of (a) a styrene monomer and (b) one or more monomers selected from the group consisting of an acrylate monomer, a methacrylate monomer, and a diene monomer.

8. The polymerized toner according to claim 6, wherein the polymer comprised in the binder resin has a weight average molecular weight of 100,000 to 200,000.

9. The polymerized toner according to claim 1, wherein one or more additives selected from the group consisting of a reaction initiator, a cross-linking agent, and a pigment stabilizer are further dispersed in the binder resin.

10. A method for preparing a polymerized toner, which comprises the steps of:

forming an aqueous dispersion containing a dispersant;

forming a monomer mixture which comprises 20 to 90 wt % of a binder resin monomer, 3 to 30 wt % of a low molecular weight polymer having the same type of repeating unit as the binder resin monomer and a weight average molecular weight of 3000 to 30,000, and a balance of a pigment, a wax, and a charge control agent; and forming toner particles through suspension polymerization after adding said monomer mixture to said aqueous dispersion.

11. The method for preparing a polymerized toner according to claim 10, wherein the polymerized toner comprises 5 to 25 wt % of the low molecular weight polymer having the same type of repeating unit as the binder resin monomer and a weight average molecular weight of 3000 to 30,000.

12. The method for preparing a polymerized toner according to claim 10, wherein the monomer mixture further comprises 0.01 to 5 wt % of the molecular weight control agent.

13. The method for preparing a polymerized toner according to claim 12, wherein the molecular weight control agent comprises one or more selected from the group consisting of t-dodecyl mercaptan, n-dodecyl mercaptan, n-octyl mercaptan, carbon tetrachloride, and carbon tetrabromide.

14. The method for preparing a polymerized toner according to claim 10, wherein the dispersant comprises one or more selected from the group consisting of an inorganic dispersant, an aqueous organic polymer dispersant, and an anionic surfactant.

15. The method for preparing a polymerized toner according to claim 10, wherein the dispersant comprises calcium phosphate.

16. The method for preparing a polymerized toner according to claim 10, wherein the binder resin monomer comprises the styrene monomer and one or more monomers selected from the group consisting of an acrylate monomer, a methacrylate monomer, and a diene monomer in a weight ratio of 10:1 to 1:1.

17. The method for preparing a polymerized toner according to claim 10, wherein the monomer mixture further comprises one or more additives selected from the group consisting of a reaction initiator, a cross-linking agent, and a pigment stabilizer.

18. The method for preparing a polymerized toner according to claim 10, wherein the step for forming the toner particles comprises the steps of:

adding the monomer mixture to the aqueous dispersion;

applying shearing force to the aqueous dispersion and the monomer mixture to homogenize the monomer mixture in the aqueous dispersion in the form of liquid droplets; and subjecting the homogenized monomer mixture to suspension polymerization.

19. The method for preparing a polymerized toner according to claim 10, which further comprises a step of removing the dispersant and a step of drying the toner particles.

20. The method for preparing a polymerized toner according to claim 10, which further comprises a step of coating the outside of the toner particles with an external additive.

* * * * *